United States Patent [19]

Alexander

[11] Patent Number: 4,944,155

[45] Date of Patent: Jul. 31, 1990

[54] VACUUM SEPARATOR FOR DEWAR FLASK COLD EXCHANGE SYSTEMS

[75] Inventor: David K. Alexander, Indianapolis, Ind.

[73] Assignee: Kadel Engineering Corporation, Danville, Ind.

[21] Appl. No.: 366,184

[22] Filed: Jun. 14, 1989

[51] Int. Cl.[5] ..... F17C 1/00

[52] U.S. Cl. ..... 62/45.1; 62/51.1; 62/268

[58] Field of Search ..... 62/45.1, 47.1, 51.1, 62/55.5, 100, 268

[56] References Cited

U.S. PATENT DOCUMENTS

| | | | |
|---|---|---|---|
| 3,364,688 | 1/1968 | Matlow et al. | 62/45.1 |
| 3,377,813 | 4/1968 | Mordhorst | 62/45.1 |
| 3,483,709 | 12/1969 | Baicker et al. | 62/514 |
| 3,807,188 | 4/1974 | Lagodmos | 62/45 |
| 4,190,106 | 2/1980 | Dunmire et al. | 62/514 |
| 4,194,119 | 3/1980 | MacKenzie | 62/514 |
| 4,277,949 | 7/1981 | Longsworth | 62/47.1 |
| 4,501,131 | 2/1985 | Gaskin et al. | 62/514 |
| 4,510,758 | 4/1985 | Tench, Jr. | 62/514 |
| 4,716,742 | 1/1988 | Germain-Lacour et al. | 62/514 |
| 4,740,702 | 4/1988 | Huang et al. | 62/514 |
| 4,766,741 | 8/1988 | Bartlett et al. | 62/47.1 |
| 4,790,147 | 12/1988 | Kuriyama et al. | 62/47.1 |
| 4,796,433 | 1/1989 | Bartlett | 62/47.1 |

*Primary Examiner*—Ronald C. Capossela
*Attorney, Agent, or Firm*—Woodard, Emhardt, Naughton Moriarty & McNett

[57] ABSTRACT

A cold exchange system includes a Dewar flask having an inner vessel and an exterior vessel joined to and surrounding the inner vessel, defining an evacuable chamber therebetween. The flask includes an evacuation port through the inner and exterior vessels through which cryogenic gas contained in the inner vessel can evaporate during the cold exchange process. The exterior vessel includes a device port through which a device to be cooled extends. The device is housed in a housing that is engaged over the device port. A cold finger is in heat transfer contact with the inner vessel. A non-metallic flexible bellows is sealingly adhered to the cold finger at one open end of the bellows. The other open end of the non-metallic bellows is sealingly adhered at its other open end to a top plate which is vacuum fitted over the device port. The non-metallic bellows and device housing define a second evacuable chamber separate from the Dewar flask vacuum chamber. The separation of the vaccum chambers is maintained by the non-metallic bellows and adhesive joints between the bellows and the cold finger and top plate. The device to be cooled is mounted in direct mechanical contact with the cold finger within the device chamber defined by the non-metallic bellows. The joint between the non-metallic bellows and the metallic cold finger and top plate is formed by an adhesive compound essentially containing an admixture of an epoxy with fine grain beads. The beads each generally have the same outer diameter to create a uniform adhesive joint, to insure a vacuum tight seal, and to provide a uniform spacing of the bellows from the aluminum components to insure long-term vacuum integrity of the adhesive joint during repeated thermal cycling.

7 Claims, 2 Drawing Sheets

VACUUM SEPARATOR FOR DEWAR FLASK COLD EXCHANGE SYSTEMS

BACKGROUND OF THE INVENTION

The present invention relates generally to cold-exchange systems, and more particularly to Dewar flask cold exchange systems and vacuum separator apparatus for such systems.

Dewar flask cold exchange or cryogenic systems or cryostats have long been used to provide extremely low and substantially constant temperature. Systems of this type are frequently used to cool electronic detectors which use high purity semi-conductors, such as infrared, x-ray, or gamma ray detectors. Cooling the semi-conductors reduces the amount of "white noise" inherent in electronic components that reduces the accuracy of the electronic detector.

In Dewar flask cryogenic systems, a cold-exchange reservoir is contained within an outer vessel, defining a chamber therebetween. A vacuum is drawn in the chamber to reduce the thermal conductivity from the reservoir to the outside environment. The reservoir is filled with a cryogenic liquid, such as liquid nitrogen, which is permitted to evaporate as gaseous nitrogen, thereby reducing the temperature of the cold-exchange reservoir. The detector to be cooled is situated apart from the cold-exchange reservoir with some type of heat transfer connection between the detector and the reservoir of the flask.

In order to prevent contamination of the high-purity semi-conductor in the detector device, some form of vacuum separator has typically been used to isolate the detector from the vacuum within the Dewar flask, while maintaining the heat transfer relationship. Typical cryogenic systems of the prior art have used a stainless steel bellows in order to maintain the separation between the detector and the Dewar flask. One problem with the metallic bellows of the prior art is that the bellows provides an additional heat transfer path from the cold-exchange reservoir to the outside environment. Thus, the cryogenic liquid within the Dewar cold-exchange reservoir evaporates at a faster rate, reducing the time the system may be operational without cryogen re-fill.

SUMMARY OF THE INVENTION

It is an object of the present invention to provide an improved Dewar flask cryogenic system, and in particular to provide an improved vacuum separator for use in such a system.

It is a further object of the present invention to provide a vacuum separator that has a lower thermal conductivity than the separators known in the prior art. A related object is to decrease the evaporation rate of the cryogenic liquid within the Dewar due to the decreased thermal conductivity of the vacuum separator.

These and other objects and benefits are obtained by the provision of a Dewar vacuum separator that includes a non-metallic bellows which defines an evacuable chamber within which the detector semi-conductor device to be cooled is disposed. The chamber defined by the non-metallic bellows is separate from the evacuable chamber of the Dewar flask. The device to be cooled is in direct mechanical and heat transfer contact with the cold finger of the Dewar flask.

In another aspect of the invention, the non-metallic bellows is composed of a plastic, such as polytetrafluoroethylene. The cold finger is composed of a metal, such as aluminum having a high thermal conductivity. The plastic bellows is adhered to an aluminum cold finger, using an adhesive compound, consisting essentially of an admixture of an epoxy and small beads of uniform diameter. The beads provide a uniform seam or adhesive line to ensure a complete, leak-proof seal between the plastic bellows and the aluminum components of the Dewar flask. In order to ensure complete adhesion of the plastic bellows to the aluminum components of the cryogenic system, both the bellows and the aluminum components are etched by appropriate etching agents.

DESCRIPTION OF THE PREFERRED EMBODIMENT

Figure 1:
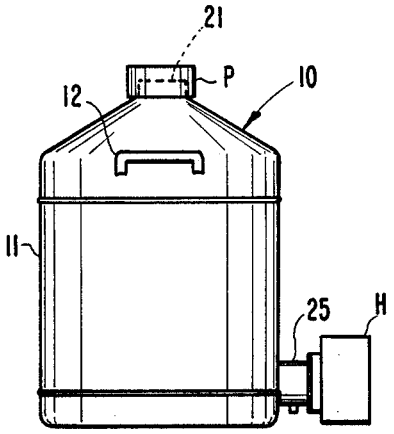
FIG. 1 is a side elevational view of the preferred embodiment of the invention wherein a Dewar flask cold exchange system is used to cool a solid state detector device.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A Dewar flask cold exchange system 10 includes an exterior vessel 11 to which a pair of handles 12 are affixed at opposite sides of the vessel. A device housing H houses a detector device having a high purity semi-conductor which is to be maintained at a low temperature by the Dewar flask 10. The flask includes a plug P at a top opening which is removable to permit recharging the flask. Preferably, the plug P is a porous plug which permits evolved cryogenic gas to escape during the cooling operation.

The exterior vessel 11 includes an upper portion **11*a*, a middle portion 11*b* and a lower dish portion 11*c*, each of which is composed of aluminum or another material suitable for maintaining a vacuum. Each of the exterior vessel portions are seam welded together to form the complete vessel once the interior components of the Dewar flask have been assembled. The flask 10 includes an inner vessel 13, preferably composed of aluminum, and having an outer wall 14 which defines a cold exchange reservoir 15. In the preferred embodiment, the reservoir is capable of holding thirty liters of a cryogenic liquid, such as liquid nitrogen, although other cryogenic liquids may be employed. The interior portion of outer wall 14 of the inner vessel 13** is preferably coated with a non-corrosive chromate conversion coating, such as the product Chromicoat® manufactured by Oakite Products, Inc.

The exterior vessel 11 and the inner vessel 13 define an annular vacuum chamber 17 which is evacuated during use of the flask in order to minimize heat transfer from the interior to the exterior of the flask. In the preferred embodiment, the annular chamber 17 is filled with a super insulating material in order to further minimize heat transfer between the cold exchange reservoir 15 and the outside environment. Impurities within the super insulating material tend to out-gas into the vacuum in the annular chamber 17. In order to reduce the amount of out-gassed impurities within the annular chamber 17, a getter 23 may be affixed to the outer wall 14 of the inner vessel 13. In the preferred embodiment, the getter is composed of charcoal.

An evaporation port 18 extends between the inner and outer vessels through which the cryogenic liquid can evaporate during the continuous cooling process. The port 18 includes a conduit 19 which is connected at one end to the inner vessel 13 by way of a flange fitting 20, and at the other end to the exterior vessel 11 by way of a plug fitting 21. The plug fitting 21 is adapted to receive the plug P mounted thereon. The conduit also provides support for the inner vessel 13 within the exterior vessel 11.

The flask 10 includes a device port 24 over which the device housing H is situated and through which the device to be cooled extends. The device port 23 includes a neck 25 having a vacuum fitting 26 projecting therefrom. The vacuum fitting 26 is used to draw a vacuum in the annular chamber 17 in preparation for use of the flask. A mounting flange 27 is situated at the end of the neck 25 and is adapted to interface with the housing H within which the detector device D is situated.

The Dewar flask 10 includes a cold finger 30 which is suitably attached to the outer wall 14 of the inner vessel 13 in heat transfer relation. The device D is mechanically connected to the cold finger 30 in heat transfer relation. Heat is drawn from the cold finger 30 to evaporate the cryogenic liquid in the reservoir 15, thereby lowering the temperature of the cold finger. Likewise, the heat is drawn from the device D through the cold finger to reduce the temperature of the device D. In the preferred embodiment, the device D is mounted on a mounting surface 43 of the cold finger. Threaded bores 44 are provided in the mounting surface so that the device can be bolted to the cold finger.

Even with the addition of the getter 23 to the flask, some gaseous impurities remain in the vacuum within the annular chamber 17. Thus, in order to protect the purity of the semi-conductor device D from the flask impurities, a vacuum separator is required to isolate the device from the vacuum in the annular chamber 17. In the present invention, the vacuum separator includes a flexible non-metallic bellows 32. Preferably, the bellows is composed of a plastic, such as polytetrafluoroethylene, which has a low thermal conductivity, is flexible and maintains its ductility at the cold temperatures associated with the Dewar flask. A suitable plastic that meets the above criteria is TEFLON® manufactured by Dupont Chemical Corp. The TEFLON® bellows has a lower thermal conductivity than the metallic bellows used in prior art so that the bellows of the present invention does not significantly alter the evaporation rate of the cryogenic liquid within the reservoir 15. The use of the non-metallic TEFLON® bellows minimizes the heat transfer path through the exterior vessel to the environment. Dewar flasks of the prior art using metallic bellows typically exhaust the cryogenic liquid in approximately twelve days. With the non-metallic TEFLON® bellows of the present invention, the evaporation period can be extended to as much as twenty days.

The bellows 13 is affixed to the cold finger 30 and held in place by a sleeve 34. A top plate 36 is attached to the neck 25 within the mounting flange 27. A seal ring or O-ring 40 is provided at the perimeter of the top plate 36 in order to maintain the vacuum in the annular chamber 17. The non-metallic bellows 32 is affixed to the top plate 36 and held in position by a second sleeve 38. Each of the components of the vacuum separator, namely the sleeve 34 and 38, and the top plate 36, is composed of aluminum in the preferred embodiment. With the attachment of the device housing H, the bellows 32 defines a detector chamber 42 within which the semi-conductor device D is disposed while in mechanical heat transfer contact with the cold finger 30. In order to reduce the amount of heat transfer between the semi-conductor device D and the outside environment, a vacuum is drawn within the detector chamber 42 and housing H.

The TEFLON® bellows is adequate to maintain the vacuum separation between the annular chamber 17 and the detector chamber 42. Moreover, the bellows 32 prevents the invasion of contaminants into the detector chamber 42, thereby protecting the purity of the semi-conductor device D.

The metallic bellows of the prior art have typically been hermetically sealed or welded to the metal components of the Dewar flask. However, typical prior attachment or sealing techniques are unsatisfactory for use with the non-metallic bellows 32 of the present. In another aspect of the preferred embodiment, means is provided to adhere the TEFLON® bellows to the aluminum components of the vacuum separator. Prior to being attached to the aluminum components, the bellows 32 is etched at the end portions of the bellows in order to enhance its ability to adhere to a metallic surface. In the preferred embodiment, the TEFLON® etchant is used, such as a commercial etchant sold under the name TETRA-ETCH® manufactured by W. L. Gore & Associates.

Similarly, the aluminum components are also etched with a caustic solution. Thus, the cold finger 30, the sleeves 34 and 38, and the top plate 36 are each etched at least on the surfaces to which the bellows 32 is to be adhered. In the preferred embodiment, the aluminum components are etched using an alkaline etchant containing caustic soda and alkaline salts. The aluminum component is then rinsed with water and deoxidized in an acid agent which includes inorganic salts, nitric acid and a fluoride. A suitable aluminum etchant is a product sold under the name OAKITE®160, while the deoxidizing agent is sold as the product OAKITE® Deoxidizer LNC, both produced by Oakite Products, Inc., of Brooklyn Heights, N.J.

Figure 3:
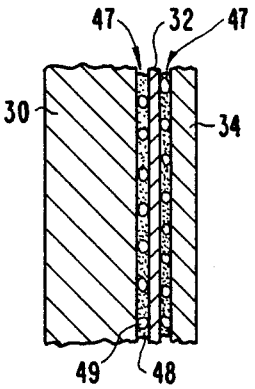
FIG. 3 is an enlarged partial cross sectional view of a section of the joint between the bellows and the metallic components of the invention shown in FIG. 2, taken along line 3—3 as viewed in the direction of the arrows.
Figure 2:
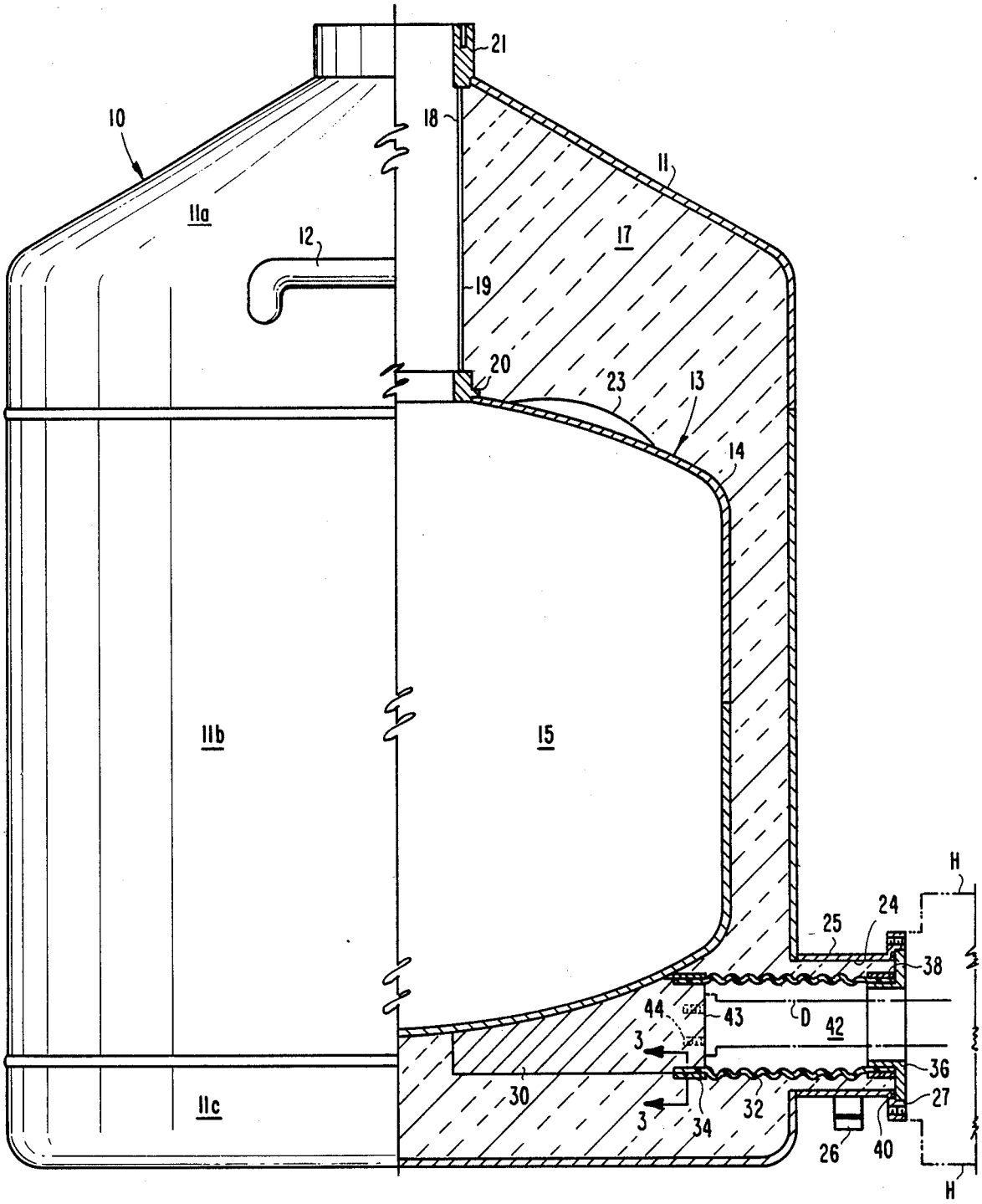
FIG. 2 is an enlarged partial cutaway view of the Dewar flask cold exchange system showing the vacuum separator of the present invention.

Once the bellows and aluminum components have been etched, they are adhered together by an adhesive compound at a joint 47, as shown in FIG. 3. In the present invention, the adhesive compound consists essentially of an admixture of an epoxy 48 and fine grade beads 49. The beads 49 are preferably glass beads normally used for grit or shot blasting, each of the glass beads have an outer diameter of approximately 0.11 millimeters or 0.0043 inches. The presence of the beads 49 in admixture with the epoxy 48 insures a uniform joint 47 or glue line between the bellows and the aluminum components. The resulting uniform joint is very leak-proof, reliable and resistant to the effects of the cold temperatures produced in the Dewar flask 10.

A suitable epoxy for admixture is an epoxy manufactured by Armstrong Products of Warsaw, Ind., sold as A-12 epoxy. Another suitable epoxy is a mixture of a resin and a hardener, such as 9615-10 hardener and EPIBOND ®1210-A resin produced by Furane Plastics Inc.

In prior art Dewar flask systems, the seal between the Dewar vacuum and the device chamber vacuum maintained by the vacuum separator is typically tested by first drawing a vacuum in the flask and then pumping helium gas into the device port. A mass spectrometer is then used to ascertain the amount of helium that has leaked into the flask vacuum chamber. However, the plastic bellows of the present invention, and in particular the TEFLON ® bellows, is susceptible to diffusion of helium gas through the bellows wall. Consequently, in another aspect of the present invention, nitrogen gas is diluted with 50 ppm (parts per million) helium gas. This ratio of helium gas is adequate for detection by mass spectrometry without resulting in significant diffusion of the helium through the walls of the bellows.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cold exchange system for cooling a device in a device housing comprising:

a Dewar flask including;

an inner vessel for containing a cryogenic liquid;

an outer vessel joined to and surrounding said inner vessel and defining a first evacuable chamber therebetween;

an evaporation port through said inner vessel and said outer vessel through which the cryogenic liquid can evaporate;

a device port through said outer vessel; and means for sealingly engaging the device housing to said outer vessel in communication with said device port;

a cold finger in heat transfer relation with said inner vessel;

a vacuum separator including;

a flexible non-metallic bellows having open ends, sealingly engaged at one of said ends to said cold finger and at the other of said ends to said outer vessel in communication with said device port, whereby said non-metallic bellows and the device housing define a second evacuable chamber separate from said first evacuable chamber; and means for mounting the device to be cooled within said bellows in direct mechanical contact and heat transfer relation with said cold finger.

2. The cold exchange system of claim 1 wherein said non-metallic bellows is composed of a plastic.

3. The cold exchange system of claim 2, wherein:

said non-metallic bellows is composed of a polytetrafluoroethylene compound.

4. The cold exchange system of claim 3, wherein:

said cold finger is composed of aluminum; and said outer vessel includes an aluminum plate affixed to said outer vessel with an opening therethrough in communication with said device port;

said non-metallic bellows is sealingly engaged at said other of said ends to said aluminum plate, wherein the sealing engagement between said non-metallic bellows and said cold finger, and between said non-metallic bellows and said plate includes a joint filled with an adhesive compound.

5. The cold exchange system of claim 4, wherein said cold finger, said plate and said non-metallic bellows are each etched prior to being sealing engaged by said adhesive compound.

6. The cold exchange system of claim 4 wherein the sealing engagement includes means for maintaining a uniform thickness of said adhesive compound throughout said joints.

7. The cold finger of claim 6, wherein said adhesive compound consists essentially of an admixture of an epoxy and fine grade abrasive beads, said beads each having generally the same outer diameter.

* * * * *